US005222339A

United States Patent [19]

Hendrickson et al.

[11] Patent Number: 5,222,339

[45] Date of Patent: Jun. 29, 1993

[54] GLAZING SYSTEM

[75] Inventors: Leslie B. Hendrickson, Roseau; Charles G. Eaton, Badger; Laurence D. Battles, Roosevelt, all of Minn.

[73] Assignee: Marvin Lumber and Cedar Co., Warroad, Minn.

[21] Appl. No.: 666,268

[22] Filed: Mar. 8, 1991

[51] Int. Cl.[5] ..... E04C 3/00

[52] U.S. Cl. ..... 52/456; 52/772; 52/780; 52/461; 52/458; 52/465

[58] Field of Search ..... 52/456, 457, 458, 507, 52/460, 461, 464, 465, 468

[56] References Cited

U.S. PATENT DOCUMENTS 2,866,527 12/1956 Schilling ..... 52/780
4,222,210 9/1980 Hanstein et al. ..... 52/772

FOREIGN PATENT DOCUMENTS 0513175 8/1952 France ..... 52/772

*Primary Examiner*—David A. Scherbel
*Assistant Examiner*—Wynn E. Wood
*Attorney, Agent, or Firm*—Lawrence M. Nawrocki

[57] ABSTRACT

Apparatus for use in integrating multiple glass panels into a latticed-type structure (e.g., a door or window). The structure is a light-admitting, unified entity and includes a muntin which is positioned between two adjacent, coplanar glass panels. The Muntin carries a flange which is generally parallel to a plane defined by the glass panels, the flange being in engagement with first sides of the panels. A cap is positioned overlying the Muntin on a side of the glass panels opposite that on which the flange is disposed. The cap is positioned immediately adjacent, and in engagement with, second sides of the glass panels. Structure is provided to secure the cap to the Muntin in a manner such that visible surfaces of the cap and the flange are not marred. Securement is effected in a manner so that the glass panels are sandwiched between the cap and flange.

3 Claims, 2 Drawing Sheets

GLAZING SYSTEM

TECHNICAL FIELD

The present invention deals broadly with the field of millwork. More specifically, however, it deals with systems for securing together and sealing multiple glass panes to be mounted in, for example, windows and doors. The focus of the invention is directed to structure for manufacturing window and door structures without employment of nails, screws, etc. which mar wood surfaces and make them unsightly.

BACKGROUND OF THE INVENTION

Windows and doors having multiple panes of glass have been employed in buildings, and, particularly, residential dwellings, for many years. New construction homes frequently employ multiple panel windows which are attractive to the eye, and this is particularly true in more expensive homes. Such aesthetically-pleasing windows are intended to make the home not only comfortable and insulated from conditions external to the house, but also to increase the value of the home in view of its attractive appearance.

In structures known in the prior art, glass panels are "glazed" into frame members by nailing or screwing the frame members about the panels in a conventional manner. Certainly, such construction provides windows which are afforded with a high measure of structural integrity. If conventional fasteners are employed, they are, typically, counter-sunk beneath the visible surface into which they are inserted, and some sort of filling material is inserted into the counter-sunk holes and sanded once the material dries in order to provide a flush surface. Even after sanding, however, the fact that holes were previously existent can still be determined. Particularly upon close inspection, the trained eye can ascertain that fasteners such as nails or screws were used. When large sums of money are being invested in a dwelling employing such a window, this can be less than completely desirable.

In windows of this nature, a weather seal must be provided around each pane. In the prior art, liquid sealing material such as silicone or butyl have been used. Such materials, however, tend to be messy and difficult to work with.

It is to these problems and dictates of the prior art that this invention is directed. It is a glazing system which is convenient and easy to use in the manufacture of windows and doors. At the same time, it provides an unblemished appearance to the window or door product thus provided.

SUMMARY OF THE INVENTION

The present invention is a system for glazing glass panels into a structure through which light is to be admitted. The apparatus functions to integrate multiple glass panels into a unified structure, and it includes a muntin which is positioned between two adjacent glass panels which are substantially co-planar. The muntin carries a flange which is generally parallel to a plane defined by the adjacent glass panels. The flange is in engagement with first sides of the adjacent panels. The apparatus further includes a cap which is disposable on a side of the glass panels opposite the flange in a position wherein it overlies the muntin. In that position, the cap is in engagement with sides of the panels opposite those with which the flange is in engagement. Means are provided to secure the cap tightly to the muntin, the securing means being such that no marring of visible surfaces of the cap and flange is permitted to occur.

Such a structure, resultantly, effects sandwiching of adjacent glass panels between the cap and the flange carried by the muntin. Additionally, such a structure, in view of the fact that no marring is provided, can be aesthetically moulded to further enhance the appearance of the structure.

In the preferred embodiment of the invention, the means for securing the cap to the muntin includes an elongated member having first and second ends. Slots are provided in opposed surfaces in the cap and the muntin, and those slots are in registration when the cap is in an intended position. As a result, the generally linearly-extending elongated member can be received, at one end, in the slot in the muntin, and, at the other, in the slot in the cap.

In order to facilitate securing, each end of the elongated member can be provided with a barb or barbs, the barb or barbs extending outwardly from the end of the member to which they are attached and toward the other end of the member. When multiple barbs are provided, they would be spaced axially along the respective ends of the elongated member.

A barb construction employing a pair of wings is envisioned. One wing would be disposed on either side of the respective end of the member by which it is carried. Both wings, it is intended, extend outwardly and toward an end of the member opposite the end by which the barb is carried.

In the preferred embodiment, the elongated member includes, at a location generally centrally therealong, a glazing bead. The bead is disposed with respect to the main body portion of the elongated member generally transverse thereto. The bead is positioned to extend on either side of the main body portion of the elongated member main body portion. As a result, when the member functions to secure the cap to the muntin, the glazing bead becomes sandwiched between the cap and the faces of the glass panels opposite the inwardly facing surface of the cap. A sealing function is, thereby, achieved.

When a glazing bead as described is employed, it will be able to be seen that the bead will be provided with opposite distal edges. It is envisioned that those edges would extend generally parallel to the muntin when the bead is in position as a result of the elongated member effecting securing of the cap to the muntin.

The preferred embodiment includes a deformable bulb carried by each edge of the glazing bead. Typically, such a deformable bulb would be generally tubular in shape.

The present invention is thus an improved glazing system for multiple glass panel structures for admitting light into the interior of a building. More specific features and advantages obtained in view of those features will become apparent with reference to the DETAILED DESCRIPTION OF THE INVENTION, appended claims, and accompanying drawing figures

DETAILED DESCRIPTION OF THE INVENTION

Figure 1:
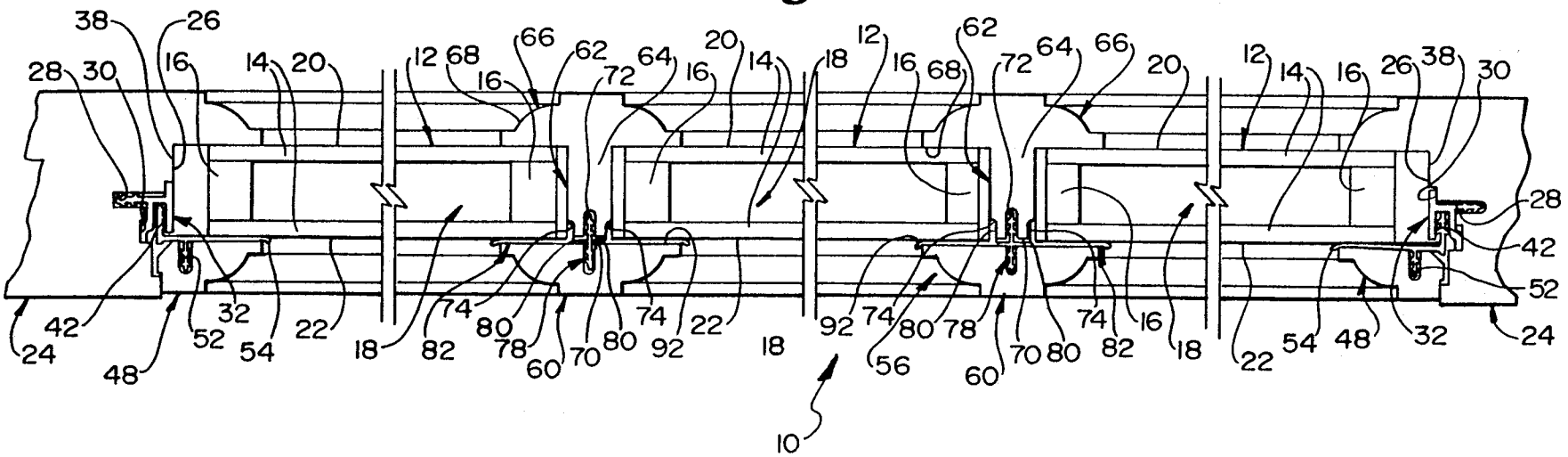
FIG. 1 is a profile diagram of a section through a window incorporating the present invention.

Referring now to the drawings, wherein like reference numerals denote like elements throughout the several views, FIG. 1 illustrates, in horizontal section, a multi-pane window 10 known as an ADL (authentic divided bite) window. The window 10 illustrates a plurality of window panels 12, each comprising a pair of glass panes 14 spaced from one another spaced by a spacer block 16 at each edges thereof. A cavity 18 is, thereby, defined within the window panel 12, and such a cavity 18 functions to facilitate insulation.

As discussed, each panel 12, in fact, comprises a pair of spaced panes 14. For purposes of discussion hereinafter, however, each panel 12 will be referred to as if it comprised a single pane having oppositely-facing, first and second surfaces 20, 22.

The window panels 12 are held in place within the window frame by utilizing a "glazing" method. Lateral edge frames 24 are defined within the wall in which the window 10 is to be installed, and the edge frames 24 are milled so as to accommodate an outermost panel or panels 12 intended to engage the edge frame 24. It will be understood that, typically, the overall window structure would comprise a matrix of both horizontally and vertically spaced panels 12.

Inwardly facing surfaces 26 of the edge frames 24 are provided with milled grooves 28 and recesses 30 to receive an interior edge fastener 32. The fastener 32 includes a land 34, which, when a barbed spine 36, extending generally transverse the land 34, is received within the groove 28 in the edge frame 24, forms a continuity of the inwardly facing surface 26 against which the window panel 12 abuts. As a result, a lateral edge 38 of the window panel 12 abuts, in part, against the surface 26 of the edge frame 24 and the land 34 of the interior edge fastener 32.

The spine 36, extending generally transverse to the land 34, is received within the groove 28 formed in the edge frame 24. The spine 36 is provided with one or more barbs 40 which are deformable in nature. When the barbs 40 are in their normal extended position, they define a diameter of the spine 36 which is greater than the diameter of the groove 28. As a result, when the spine 36 is inserted into the groove 28, wings of the barb 40 will deform to facilitate insertion. Thereafter, however, because of the angling of the wings, withdrawal of the fastener 32 from the groove 28 is inhibited.

Figure 7:
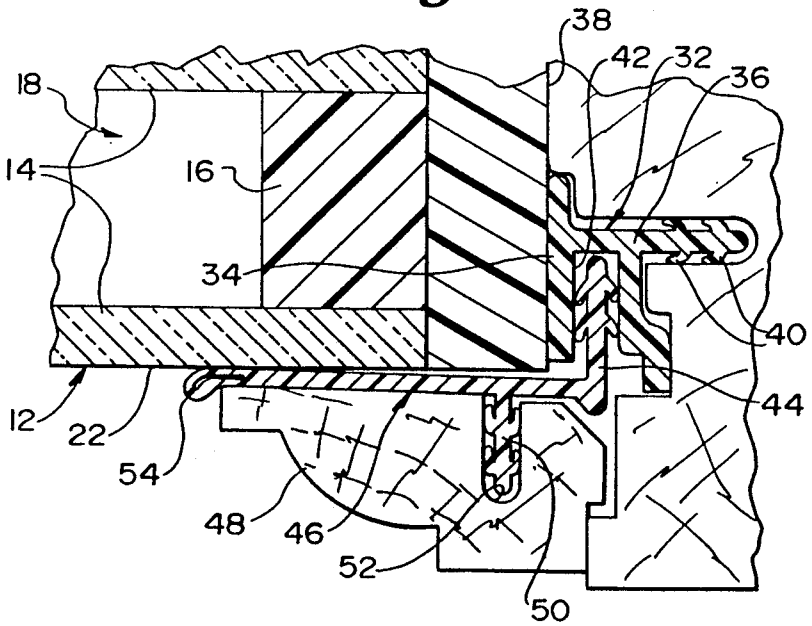
FIG. 7 is an enlarged fragmentary detailed section view of frame joint and seal assembly.

The interior edge fastener 32 is, further, provided with a slot 42 which, when the fastener 32 is in position, relative to the edge frame 24, is generally perpendicular to a plane defined by an in-place window panel 12. This slot 42 is intended to receive a barb carrying spine 44 of a second fastener 46 which, when the window panel 12 is in place, is positioned along with a molding 48 to hold the window panel 12 at its edge in engagement with the edge frame 24 within which the window is received. As seen in FIGS. 1 and 7, the second fastener 46 is also provided with a spine 50, in addition to the spine 44 received within the first fastener 32, which extends in a direction from the main body portion of the second fastener 46 in a direction opposite that in which the first spine 44 extends. This spine 50 can, thereby, be received in a groove 52 in the inside edge molding 48.

It will be noted that an end of the second fastener 46 is provided with a deformable bulb 54. Typically, this bulb 54 would be tubular in form and extend the full vertical dimension of the fastener 46. The bulb 54 is deformed when the inside edge molding 48 is cinched tightly against the window panel 12 to hold the panel 12 within the frame 24. A sealing function is, thereby, accomplished.

It will be understood that the first and second fasteners 32, 46 can be formed from any appropriate resilient material. A vinyl material has been found to be particularly appropriate for this purpose.

Figure 4:
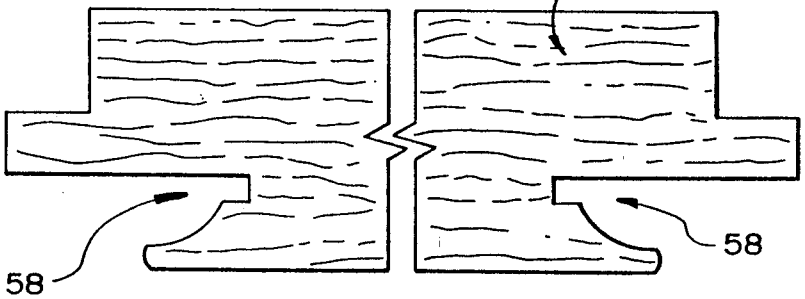
FIG. 4 is a shortened side view of a third framing member.
Figure 3:
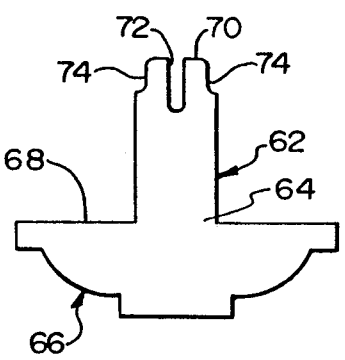
FIG. 3 is a profile view of a second framing member thereof.

FIG. 4 illustrates a horizontal framing member 56. Such a framing member 56 can extend horizontally both at the top and bottom of the window. FIG. 4 illustrates the framing member 56 as having keyways 58 formed therein to receive a cap member 60 which will be discussed hereinafter.

For purposes of discussion hereinafter, the upper side of the structure illustrated in FIG. 1 is intended to represent the outside of the building in which the window 10 is installed. The lower side of the structure, of course, represents the inside of the building. A series of muntins 62 are provided, one between each pair of adjacent window panels 12. A muntin 62 functions as a spacer to position adjacent panels 12 relative to each other. A muntin 62 also functions to close the space between adjacent panels 12 for insulative purposes.

An outer end 64 of the muntin 62 carries a flange 66 which extends generally parallel to a plane defined by the adjacent glass panels 12. It is intended that an inwardly facing surface 68 of the flange 66 carried by the muntin 62 be in engagement with outwardly facing surfaces 20 of the glass panels 12.

A muntin 62 is afforded a dimension in a direction generally transverse to a plane defined by the panels 12 approximately the same as the thickness of the glass panels 12. An inwardly facing surface 70 of the muntin 62, thereby, is generally flush with inwardly facing surfaces 22 of the adjacent panels 12. An inwardly facing surface of the muntin 70 is provided with a central slot 72 and lateral recesses 74, the slot 72 and recesses 74 extending substantially the full vertical length of the muntin 62. As seen in FIG. 1, the slot 72 and recesses 74 serve to receive, respectively, one end 76 of the main body portion of an elongated member 78 and a pair of parallel fences 80 carried by a joining/sealing fastener 82.

As in the case of the second fastener 46 at the edge frame 24, distal edges of the joining/sealing glazing bead fastener 82 are provided respective deformable bulbs 84. These bulbs 84, When the joining/sealing glazing fastener 82 is in position with the main body portion of the elongated member 78 received within the groove 72 of the muntin 62, extend generally parallel to the muntin 62. The deformable bulbs 84, however, are spaced sufficiently in view of the length of the fastener flange 86, so that the bulbs 84 engage inwardly facing surfaces 22 of the adjacent window panels 12.

Figure 5:
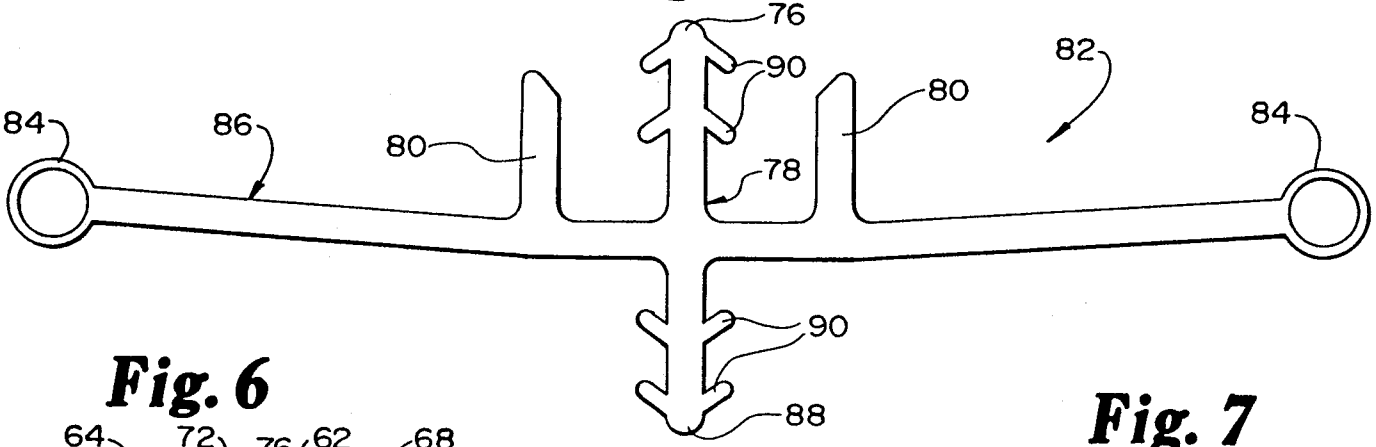
FIG. 5 is an enlarged profile view of a securing mechanism for attaching the cap to the muntin.

As best seen in FIG. 5, the second end 88 of the elongated member 78 extends beyond the inwardly facing surface of the flange 86 of the joining/sealing fastener 82. The whole fastener assembly, however, is unitarilly formed, and it can be manufactured from a vinyl material as is true in the case of the first and second fasteners 32, 46 disposed proximate the edge frames 24.

Figure 2:
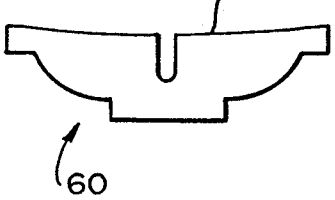
FIG. 2 is a profile view of a first framing member thereof.
Figure 6:
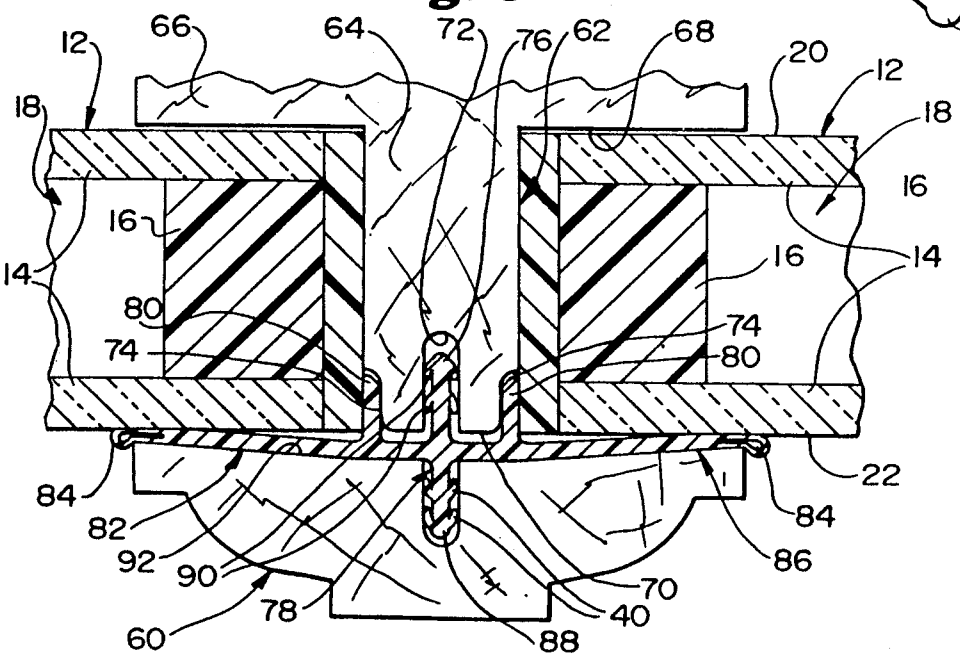
FIG. 6 is an enlarged fragmentary section detail view of the fastener of FIG. 5 in place securing a cap to a muntin.

The cap member 60 is illustrated in FIG. 2 and is shown, in FIGS. 1 and 6 as being in place in the window assembly. The cap member 60 is provided with a lateral dimension similar to that of the joining/sealing glazing bead fastener flange 86. As result, when the cap member 60 is cinched up against inwardly facing surfaces 22 of the adjacent glass panels 12, the edges of the cap member 60 will impinge upon the deformable bulbs 84 to effect a seal on both sides of the cap member 60. As is true in the case of the first and second fastener members 34, 46 utilized proximate the edge frames 24, the elongated member 78 of the joining/sealing glazing bead fastener 82 is provided with barbs 90. Barbs at one end of the fastener extend inwardly toward the opposite end as they flair outwardly. Consequently, and in view of the fact that the dimension from the tip of one wing to the tip of the corresponding wing is greater than the dimension of the slot within which the end of the elongated member 78 is received, retention will be achieved. The first end 76 of the elongated member 78 is received within the slot or groove 72 formed in the inwardly facing surface 70 of the muntin 62. The second end 88 of the elongated member 78 is received within a groove formed centrally within a surface 92 of the cap member 60 which engages the flange 86 of the joining/sealing glazing bead fastener 82.

An assembly of the window is accomplished by placing the various panels 12, edge framing members 24, horizontally disposed framing members 56, etc. in appropriate relative positions with respect to one another. This is done in an appropriate manner known in the industry (i.e., employing a jig). Once the panels 12 and framing members 24, 56 are in position, an assembly of a muntin 62 and its carried flange 66 is inserted between two adjacent window panels 12. The assembly is inserted sufficiently so that an intended inwardly facing surface 68 of the flange 66 comes to be in engagement with outwardly facing surfaces 20 of adjacent glass panels 12. As previously discussed with the flange 66 in this position, the inwardly facing surface 70 of the muntin 62 will be substantially flush with inwardly facing surfaces 22 of the glass panels 12.

The joining/sealing glazing bead fastener 82 can then be moved into a position wherein a first end 76 of the elongated member 78 is inserted into the slot 72 formed in the inwardly facing surface 70 of the muntin 62. As this insertion occurs, the fence member 80 of the bead fastener 82 ease into the recesses 74 formed in lateral edges of the muntin 62. Even though the fastener bead 82 has some deformabiltiy and resiliency, this structuring will provide a relative measure of rigid positioning. The glazing bead fastener 82 would be cinched tightly against the inwardly facing surfaces 22 of the adjacent glass panels 12. Thereafter, the cap member 60 would be applied to the glazing bead fastener 82 and cinched up against the fastener 82. Thereafter, pressure could be applied to both the flange 66 carried by the muntin 62 and the cap member 60 to ensure all excess space is removed.

It will be understood that, in practice, there would be a series of muntin/flange/cap member assemblies, since there are a plurality of vertical columns and horizontal rows of window panels, typically. In view of such a latice-work construction, it will also be understood that, where necessary, milling can be effected to assure interfit of the various component parts.

As will come to be understood also, in view of the structure and construction method, an ADL window can be sturdily and economically constructed. Effective sealing is accomplished, and at the same time, messy liquid sealants are avoided. The structure thereby provided is not only easier to construct, but also comes out in final form more aesthetically-pleasing.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

I claim:

1. Apparatus for integrating multiple glass panels in a light-admitting structure into a unified entity, comprising:

(a) a muntin disposed intermediate two adjacent, coplanar glass panels said muntin carrying a flange, generally parallel to a plane defined by the glass panels, in engagement with first sides of the panels, said flange having outwardly facing surfaces which are aesthetically molded, a surface of said muntin facing in a direction opposite that at which said flange is carried having a slot formed therein;

(b) a cap disposable, overlaying said muntin on a side of the glass panels opposite said flange and in engagement with second sides of the panels, said cap having outwardly facing surfaces which are aesthetically molded, a surface of said cap facing said muntin having formed therein a slot registrable with said slot formed in said muntin when said cap is in its position in engagement with said muntin;

(c) an elongated member having first and second ends receivable in said slots formed in said muntin and said cap;

(d) a first resilient barb carried by first end of said elongated member, are first resilient barb extending outwardly and toward said second end of said member;

(e) a second resilient barb carried by said second end of said member, said second resilient barb extending outwardly and toward said first end of said member;

(f) a glazing bead, positioned generally centrally along said elongated member and extending generally transverse to a main body portion of said elongated member, disposed on either side of the main body portion of said elongated member so that, when said elongated member functions to secure said cap to said muntin, said glazing bead is sandwiched between said cap and said second sides o the glass panels; and (g) a deformable bulb carried by each of opposite edges of said glazing bead which extend generally parallel to said muntin, each deformable bulb being generally tubular in shape;

(h) wherein said first and second ends of said elongated member, including the barb carried thereby, each have a maximum dimension, perpendicular to an axis of elongation of said member, greater than a corresponding dimension of the slot in which a barb is received so that, as said first and second ends of said member are inserted into said respective slots in said muntin and said cap, said barbs will preclude retraction of said member from said slots.

2. Apparatus in accordance with claim 1 wherein each of said barbs comprises a pair of wings, one wing disposed on either side of a respective end of said member, both wings extending outwardly and toward an end of said member opposite the end by which said wings are carried.

3. Apparatus in accordance with claim 2 wherein each end of said member carries a plurality of axially-spaced barbs which extend outwardly and toward an end of said member opposite said end by which sad barbs are carried.

* * * * *